US007229302B1

(12) United States Patent
Lai

(10) Patent No.: US 7,229,302 B1
(45) Date of Patent: Jun. 12, 2007

(54) POWER STRIP

(76) Inventor: Li-Chun Lai, 21F-1, No. 33, Sec.1, Minsheng Rd., Panciao City, Taipei County (TW)

( * ) Notice: Subject to any disclaimer, the term of this patent is extended or adjusted under 35 U.S.C. 154(b) by 0 days.

(21) Appl. No.: 11/456,571

(22) Filed: Jul. 11, 2006

(51) Int. Cl.
*H01R 4/60* (2006.01)

(52) U.S. Cl. ..... 439/214; 439/502; 439/505

(58) Field of Classification Search ..... 439/214, 439/502, 505
See application file for complete search history.

(56) References Cited

U.S. PATENT DOCUMENTS 4,780,094 A * 10/1988 Batty et al. ..... 439/492
5,855,494 A * 1/1999 Blaszczyk et al. ..... 439/502
6,500,025 B1 * 12/2002 Moenkhaus et al. ..... 439/502
6,672,896 B1 * 1/2004 Li ..... 439/502
6,710,254 B2 * 3/2004 Yueh ..... 174/135
6,767,255 B1 * 7/2004 Croswell ..... 439/651
6,913,482 B1 * 7/2005 Wu ..... 439/502

* cited by examiner

*Primary Examiner*—Truc Nguyen

(57) ABSTRACT

A power strip includes a primary distribution unit, a secondary distribution unit, a primary power cord, at least two secondary power cords and at least two third-level power cords. The primary distribution unit has three distribution points, and each of the three distribution points is in electrical communication with a respective line of the three lines (positive line, neutral line and ground line) of the primary power cord. An electrical plug is provided at the free end of the primary power cord, and each of the three lines of each secondary power cord is in electrical communication with a respective distribution point. Also, each secondary power cord is in electrical communication with at least two third-level power cords. Hence, electricity may be fed from the electrical plug to the primary power cord, secondary power cords and third-level power cords and then to the sockets.

5 Claims, 2 Drawing Sheets

POWER STRIP

BACKGROUND OF THE INVENTION

1. Field of the Invention

The invention generally relates to a power strip. More particularly, the invention relates to an improved power strip which includes at least two secondary power cords and at least two third-level power cords so as to provide electricity to a user.

2. Description of the Prior Art

A relevant patent is U.S. Pat. No. 6,486,407 ("power strip with adjustable outlets") which claims a power strip comprising: a first power cord having a proximal end and a distal end, said first power cord adapted to receive an input of electricity; a second power cord having a proximal end and a distal end; a third power cord having a proximal end and a distal end; and a bus system directly connected to said proximal end of said first power cord, said proximal end of said second power cord, and said proximal end of said third power cord; whereby said first power cord is adapted to be in electrical communication with said second power cord and said third power cord.

In the relevant patent, because of "a bus system directly connected to said proximal end of said first power cord, said proximal end of said second power cord, and said proximal end of said third power cord", such power strip is difficult to assemble.

Hence, we can see that such power strip needs to be improved.

To eliminate the disadvantages of the power strip of the relevant patent, the inventor has put in a lot of effort in the subject and has successfully come up with the improved power strip of the present invention.

SUMMARY OF THE INVENTION

The present invention is to provide an improved power strip in which a screw is used at each of the three distribution points of the primary distribution unit to connect the three lines (positive line, neutral line and ground line) of the primary power cord with the three lines (positive line, neutral line and ground line) of each secondary power cord so as to make the assembly of the power strip easier.

Another, the present invention is to provide an improved power strip that is structurally simple, highly useful and easy to use.

The improved power strip of the present invention comprises a primary distribution unit, a secondary distribution unit, a primary power cord, at least two secondary power cords and at least two third-level power cords. The primary distribution unit has three distribution points, and a screw is used at each of the three distribution points. Two dividing pieces divide the internal space of the secondary distribution unit into three segments. The primary power cord includes a positive line, a ground line and a neutral line; similarly, each of the secondary power cords includes a positive line, a ground line and a neutral line, and each of the third-level power cords includes a positive line, a ground line and a neutral line. An electrical plug is provided at the free end of the primary power cord, and a socket is provided at the free end of each of the third-level power cord. Through the three distribution points of the primary distribution unit, the three lines (positive line, neutral line and ground line) of the primary power cord is in electrical communication with the three lines (positive line, neutral line and ground line) of each of the secondary power cords. Also, the three lines (positive line, neutral line and ground line) of each of the secondary power cords is in electrical communication with the three lines (positive line, neutral line and ground line) of the respective third-level power cord(s) through the secondary distribution unit. Each of the three joints where the three lines of each of the secondary power cords connect with the three lines of the each of the third-level power cords is disposed in the respective segment so as to avoid short-circuiting. Hence, electricity may be fed from the electrical plug to the primary power cord, secondary power cords and third-level power cords and then to the sockets.

These features and advantages of the present invention will be fully understood and appreciated from the following detailed description of the accompanying Drawings.

DETAILED DESCRIPTION OF THE PREFERRED EMBODIMENT

Figure 1:
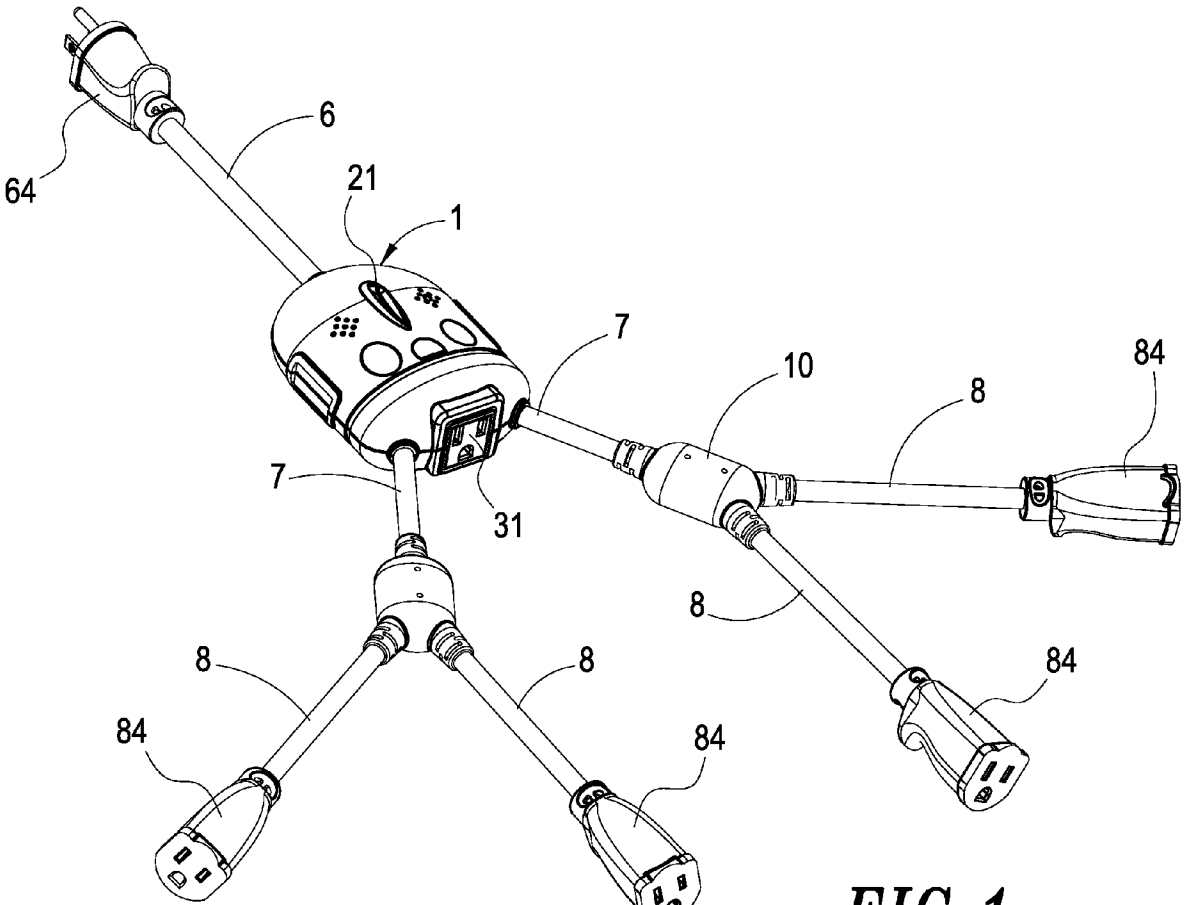
FIG. 1 is a perspective view of the improved power strip of the present invention.
Figure 3:
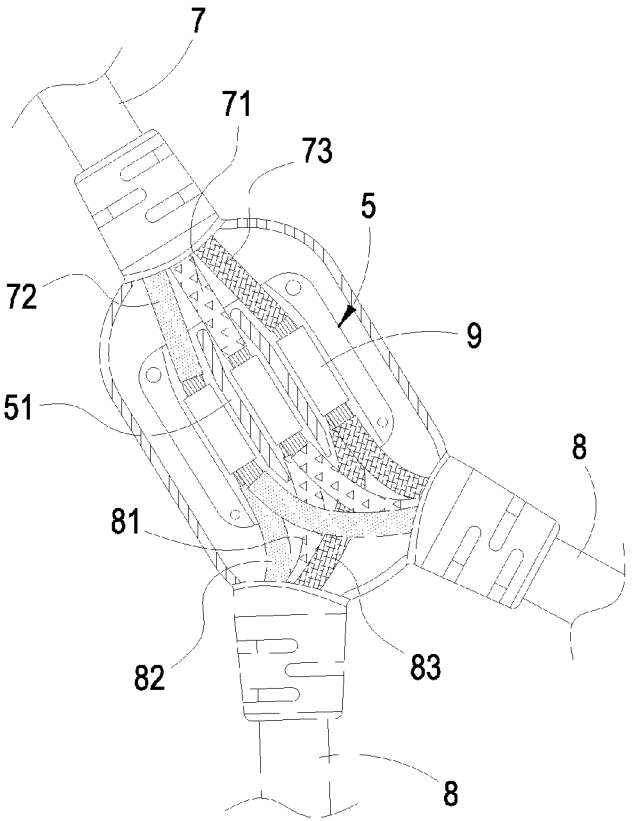
FIG. 3 is a front sectional view of the secondary distribution unit of the improved power strip of the present invention.
Figure 2:
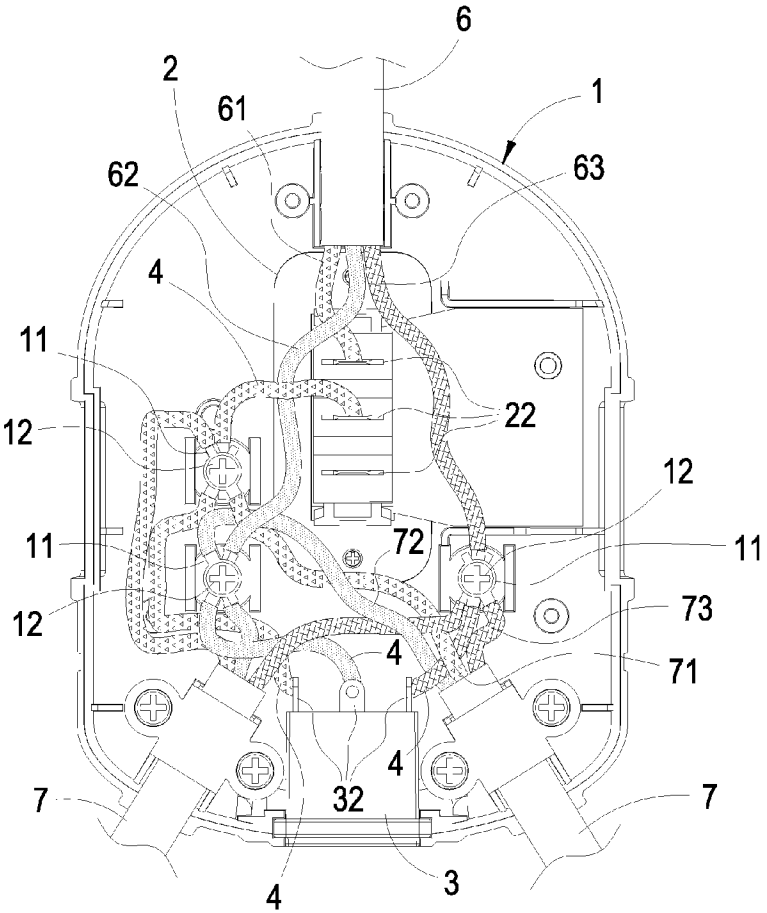
FIG. 2 is a front sectional view of the primary distribution unit of the improved power strip of the present invention.

As showed in FIGS. 1 to 3, the improved power strip of the present invention comprises a primary distribution unit 1, a secondary distribution unit 5, a primary power cord 6, at least two secondary power cords 7 and at least two third-level power cords 8.

The primary distribution unit 1 has three distribution points 11, and a screw is used at each of these distribution points 11. A switch 2 and a socket 3 are provided on the primary distribution unit 1. Both the switching portion 21 of the switch 2 and the three insertion holes 31 of the socket 3 extend out of the primary distribution unit 1. Either the switch 2 or the socket 3 has three connecting portions 22 and 32. Each of three connecting portions 32 of the socket 3 is connected with a respective wire 4. Each of the three wires 4 is connected with the respective distribution point 11. In addition, an overload protection device (not shown in the drawings) may be provided on the primary distribution unit 1 to protect against overloads.

The secondary distribution unit 5 has two dividing pieces 51, which can divide the internal space of the secondary distribution unit 5 into three segments.

The primary power cord 6 includes three lines: a positive line 61, a ground line 62 and a neutral line 63. An electrical plug 64 is provided at the free end of the primary power cord 6. At the other end, either the ground line 62 or the neutral line 63 is connected with a respective distribution point 11. The positive line 61 is connected with one of the three connecting portions 22 of the switch 2. A wire 4 is used to connect another connecting portion 22 with the distribution point 11 that is not connected with the ground line 62 or the neutral line 63.

Each of the at least two secondary power cords 7 also includes three lines: a positive line 71, a ground line 72 and a neutral line 73. Each of these three lines 71, 72 and 73 is connected with the respective distribution point 11 of the primary distribution unit 1. A screw is used at each of these distribution points 11 so as to affix the lines the primary power cord 6 and the secondary power cords 7.

Each of the at least two third-level power cords 8 also includes three lines: a positive line 81, a ground line 82 and a neutral line 83. A socket 84 is provided at the free end of each power cord 8. Three connecting pieces 9 are used to connect the three lines 81, 82 and 83 of each power cord 8 with the three lines 71, 72 and 73 of the respective power cord 7. The three connecting pieces 9 are separated by the previously mentioned two dividing pieces 51 so as to separate the positive lines 71, 81, the ground line 72, 82 and the neutral line 73, 83 from each other to avoid short-circuiting. Hence, electricity may be fed from the electrical plug 64 to the primary power cord 6, secondary power cords 7 and third-level power cords 8 and then to the sockets 84.

Optionally, a layer may be coated on the secondary distribution unit 5 so as to embellish it.

In comparison to the power strip of the previously mentioned patent, the improved power strip of the present invention has the following two advantages:

1. In the improved power strip of the present invention, a screw is used at each of the three distribution points of the primary distribution unit to connect the three lines (positive line, neutral line and ground line) of the primary power cord with the three lines (positive line, neutral line and ground line) of each secondary power cord. Hence, the improved power strip of the present invention may be assembled easily.

2. The improved power strip of the present invention is structurally simple, highly useful and easy to use.

Although a preferred embodiment of the present invention has been described in detail hereinabove, it should be understood that the preferred embodiment is to be regarded in an illustrative manner rather than a restrictive manner, and all variations and modifications of the basic inventive concepts herein taught still fall within the scope of the present invention.

From the above, we can see that the improved power strip of the present invention meets the relevant patent requirements. It is hoped that the patent application will be approved.

What is claimed is:

1. A power strip comprising:

a primary distribution unit, having three distribution points, wherein a screw is used at each of the three distribution points;

a secondary distribution unit, wherein two dividing pieces divide an internal space of the secondary distribution unit into three segments;

a primary power cord, including a positive line, a ground line and a neutral line, wherein an electrical plug is provided at a free end of the primary power cord and each of the three lines of the primary power cord is in electrical communication with a respective distribution point;

a plurality of secondary power cords, wherein each of the secondary power cords includes a positive line, a ground line and a neutral line, and wherein each of the three lines of the secondary power cord is connected with a respective distribution point of the primary distribution unit and a screw is used at each of these distribution points so as to affix the lines of the primary power cord and the secondary power cords; and a plurality of third-level power cords, wherein each of the third-level power cords includes a positive line, a ground line and a neutral line, and wherein three connecting pieces are used so as to connect the three lines of each third-level power cord with the three lines of the respective secondary power cord and each of the three connecting pieces is disposed in a respective segment, so that electricity is fed from the electrical plug to the primary power cord, the secondary power cords and the third-level power cords and then to the sockets.

2. The power strip as in claim 1, further comprising a switch provided on the primary distribution unit and a switching portion of the switch extending out of the primary distribution unit, and wherein the positive line of the primary power cord is connected with one of the three connecting portions of the switch and a wire is used to connect another connecting portion of the switch with a respective distribution point.

3. The power strip as in claim 1, further comprising a socket provided on the primary distribution unit and the three insertion holes of the socket extending out of the primary distribution unit, and wherein the socket has three connecting portions and each of the three connecting portions is in electrical communication with a respective distribution point.

4. The power strip as in claim 1, further comprising an overload protection device provided on the primary distribution unit to protect against overloads.

5. The power strip as in claim 1, further comprising a layer coated on the secondary distribution unit.

* * * * *